US008739369B2

(12) United States Patent
Kaltenrieder et al.

(10) Patent No.: US 8,739,369 B2
(45) Date of Patent: Jun. 3, 2014

(54) CLASP FOR A WATCH BRACELET OR A BELT

(71) Applicant: Omega S.A., Bienne (CH)

(72) Inventors: Cédric Kaltenrieder, Bienne (CH); Rocco Catanese, Bienne (CH)

(73) Assignee: Omega SA, Bienne (CH)

( * ) Notice: Subject to any disclaimer, the term of this patent is extended or adjusted under 35 U.S.C. 154(b) by 0 days.

(21) Appl. No.: 13/693,836

(22) Filed: Dec. 4, 2012

(65) Prior Publication Data

US 2013/0145586 A1 Jun. 13, 2013

(30) Foreign Application Priority Data

Dec. 9, 2011 (EP) ..... 11192832

(51) Int. Cl.
*A44C 5/24* (2006.01)

(52) U.S. Cl.
USPC ..... 24/71 J; 24/265 WS; 63/3.1

(58) Field of Classification Search
USPC ..... 24/265 WS, 170, 265 BC, 191, 193, 906, 24/68 E, 71 J, 71 R, 71 ST, 483, 484; 63/3.1; 224/164; 368/282
See application file for complete search history.

(56) References Cited

U.S. PATENT DOCUMENTS

| | | | | |
|---|---|---|---|---|
| 2,446,068 | A * | 7/1948 | Valcourt | 24/71 J |
| 5,579,559 | A * | 12/1996 | Ferrario | 24/71 J |
| 5,787,554 | A * | 8/1998 | Hashimoto | 24/68 J |
| 6,023,816 | A * | 2/2000 | Okada et al. | 24/71 J |
| 6,094,782 | A * | 8/2000 | Gay et al. | 24/71 J |
| 6,457,216 | B1 * | 10/2002 | Lo | 24/265 WS |
| 7,571,519 | B2 * | 8/2009 | Sierro | 24/71 J |
| 7,797,801 | B2 * | 9/2010 | Takahashi | 24/265 WS |
| 2007/0125123 | A1 | 6/2007 | Sierro | |

FOREIGN PATENT DOCUMENTS

| | | | |
|---|---|---|---|
| EP | 1 790 247 | A1 | 5/2007 |
| EP | 2 361 523 | A1 | 8/2011 |
| JP | 9-56422 | | 3/1997 |
| WO | WO 2007/072108 | A1 | 6/2007 |

OTHER PUBLICATIONS

European Search Report issued Apr. 4, 2012 in corresponding European Application No. 11 19 2832 filed on Dec. 9, 2011 (with an English Translation).

* cited by examiner

*Primary Examiner* — Robert J Sandy
*Assistant Examiner* — Abigail Morrell
(74) *Attorney, Agent, or Firm* — Oblon, Spivak, McClelland, Maier & Neustadt, L.L.P.

(57) ABSTRACT

Clasp for a watch bracelet including a cover (2) connected on a first side to a first bracelet strand (6) and to a second bracelet strand (10) on a second side, with the insertion of a folding system (4) between the second bracelet strand (10) and the cover (2) of the clasp (1), wherein said folding system (4) includes first and second links (12, 14), the first link (12) is hinged by a first end to the second bracelet strand (10) and by a second end to the second link (14), the second link (14) is hinged in turn to the cover (2) of the clasp (1), the folding system (4) is moveable between a first position in which the first and second links (12, 14) are superposed on each other inside the cover (2) of the clasp (1), and a second position in which the first and second links (12, 14) are unfolded, said clasp (1) being characterized in that, in the first position of the folding system (4), the first link (12) is held folded down on the second link (14), the first link (12) therefore including first and second elastic locking points (22, 24) for fixing the link in the cover (2) of the clasp (1).

15 Claims, 4 Drawing Sheets

CLASP FOR A WATCH BRACELET OR A BELT

This application claims priority from European Patent Application No. 11192832.1 filed Dec. 9, 2011, the entire disclosure of which is incorporated herein by reference.

FIELD OF THE INVENTION

The present invention concerns a clasp for a watch bracelet or strap or for a belt. More specifically, the invention concerns a clasp formed of first and second links which, depending upon their respective positions, can vary the length of the bracelet or belt between a first short adjustment size and a second long adjustment size. The bracelet can therefore change from a "slipping on" size in which the user can put the watch around his wrist to a "wearing" size in which the clasp is locked. Likewise, the clasp according to the invention can act as a diving extension enabling the user to increase the length of the bracelet to accommodate the thickness of the diving suit.

BACKGROUND OF THE INVENTION

Diving suits are relatively thick to protect divers from the coldness of the water. Thus, when a diver puts on his diving suit, he needs to be able to increase the length of his diving watch bracelet so as to be able to put it around his wrist, over his diving suit.

For this purpose, it is known for diving watch bracelets to be fitted with a device known as a "diver's extension" for increasing the length of the bracelets of such diving watches. This extension conventionally includes a first adjusting link fitted with first and second parallel hinge pins extending transversely to the bracelet. The first adjusting link is connected to a link of one of the bracelet strands by the first hinge pin. The first adjusting link is associated with a second adjusting link by the second hinge pin. The second adjusting link is connected in turn to the cover of a clasp by a third hinge pin. Depending upon the respective position of the first and second adjusting links, the length of the bracelet varies between a first short adjustment size wherein the first and second links are superposed on each other in the clasp cover, and a second long adjustment size in which the first and second adjusting links are unfolded.

The diver's extension device includes a means of locking the first and second adjusting links in the short bracelet length adjustment position. In a known embodiment, this locking means is provided on the first adjusting link and includes firstly a tongue and secondly a pair of ball catches. More specifically, the tongue is provided in the extension of the first adjusting link, where the first adjusting link is hinged on the second adjusting link, whereas the ball catches are provided on the sides of the first adjusting link, in proximity to the area where the first adjusting link is connected to the end link of the bracelet strand to which the diver's extension device is hinged. The tongue is arranged to engage in a housing disposed in the clasp cover. To allow this movement of engagement, the second adjusting link must be folded down inside the clasp cover, while the first adjusting link must be presented substantially perpendicular to the plane of the clasp cover before being folded down onto the second adjusting link. If the first adjusting link is presented perpendicular to the plane of the clasp cover, the tongue is opposite the housing arranged inside the cover, and is then gradually engaged in the housing as the first adjusting link is folded onto the second adjusting link. The second adjusting link takes the form of a stretcher like frame between the arms of which the first adjusting link is housed. When the first adjusting link is almost folded down onto the second adjusting link, the ball catches provided on the flanks of the first adjusting link move back slightly, ensuring that the first adjusting link is held by friction on the second adjusting link.

The locking means described above has three drawbacks. First of all, the first adjusting link has to be presented in a well defined position, in this case substantially perpendicular to the plane of the clasp cover, so that the tongue can engage properly in the corresponding housing. If this condition is not satisfied, the diver's extension is not properly closed and the bracelet may open inadvertently, which means that the watch may be lost. Next, the order in which the two locking means, namely the tongue and the two ball catches, are operated cannot be changed. The tongue must first of all be engaged in its housing, and then it is only the ball catches which can lock the first adjusting link onto the second adjusting link. The reverse is not possible. The user must therefore learn how to use this diver's extension system and his full attention is required when handling the extension. Finally, the ball catches are systems which get dirty easily and which are not very reliable.

SUMMARY OF THE INVENTION

It is an object of the present invention to overcome the aforementioned drawbacks in addition to others by providing a clasp which is more reliable and more intuitive to operate.

The present invention therefore concerns a clasp for a watch bracelet or strap or a belt including a cover connected on a first side to a first bracelet or belt strand and to a second bracelet or belt strand on a second side, with a folding system inserted between the second bracelet or belt strand and the clasp cover, wherein this folding system includes first and second links, the first link is hinged via a first end to the second bracelet or belt strand and via a second end to the second link, the second link is hinged in turn to the clasp cover, the folding system is moveable between a first position in which the first and second links are superposed on each other inside the clasp cover, and a second position in which the first and second links are unfolded, said clasp being characterized in that, in the first position of the folding system, the first link is held folded down on the second link, the first link therefore including first and second elastic locking points for fixing the link in the clasp cover.

Owing to these features, the present invention provides a clasp for a watch bracelet or a belt wherein the folding system can be locked in a very intuitive manner. Indeed, all that is required is to fold the first link down onto the second link and then to engage the assembly in the clasp cover. A simple application of pressure on the first link causes the first and second locking points to be spontaneously fixed in the clasp cover to ensure that the folding system is locked. The user does not, therefore, need to worry about how the first link is presented in relation to the clasp cover. Moreover, it does not matter at all whether the first locking point is used before or after the second locking point. Finally, the first and second locking points operate in accordance with the principle of elasticity. The means implemented are both simple and reliable.

It will be noted that, within the meaning of the present invention, the folding system may be used either for locking the clasp or for adjusting the length of the bracelet or belt.

According to a complementary feature of the invention, the first and second elastic locking points are controlled by the same elastic means.

The fact that the first and second locking points are controlled by the same elastic means ensures that the clasp according to the invention is simple to manufacture and therefore operates reliably.

BRIEF DESCRIPTION OF THE DRAWINGS

Other features and advantages of the present invention will appear more clearly from the following detailed description of an embodiment of the clasp according to the invention. This example is given solely by way of non-limiting illustration with reference to the annexed drawing, in which.

DETAILED DESCRIPTION OF THE INVENTION

The present invention proceeds from the general inventive idea which consists in fitting the clasp of a watch bracelet or belt with a folding system which either varies the length of the bracelet or belt between a first wearing size in which the folding system is locked in the clasp cover and a second slipping on size in which the folding system is open, or increases the length of the bracelet to allow the user to accommodate the thickness of a diving suit. According to the invention, the folding system includes a first link hinged at a first end to a bracelet or belt strand and at a second end to a second link which is in turn hinged to the clasp cover. This folding system changes from a first position in which the first and second links are arranged superposed on each other inside the clasp cover, to a second position in which the first and second links are unfolded. To lock the folding system in the clasp cover, the first link has first and second elastic locking points via which the first link is spontaneously fixed in the clasp cover to ensure that the folding system is locked. This locking system is thus very intuitive to use. It is not necessary to place the first link in a determined position to lock the folding system. The user simply has to fold the first link onto the second link and exert a slight pressure on the first link for the folding system as a whole to spontaneously be locked inside the clasp cover. Moreover, the order in which the first and second locking points are operated is of no importance whatsoever. Finally, the locking points operate in accordance with the principle of elasticity. They are thus simple and consequently reliable.

The present invention will be described with reference to a watch bracelet. It goes without saying however that this example is given purely by way of non-limiting illustration and that the clasp according to the invention may also be used for a belt.

Figure 1:
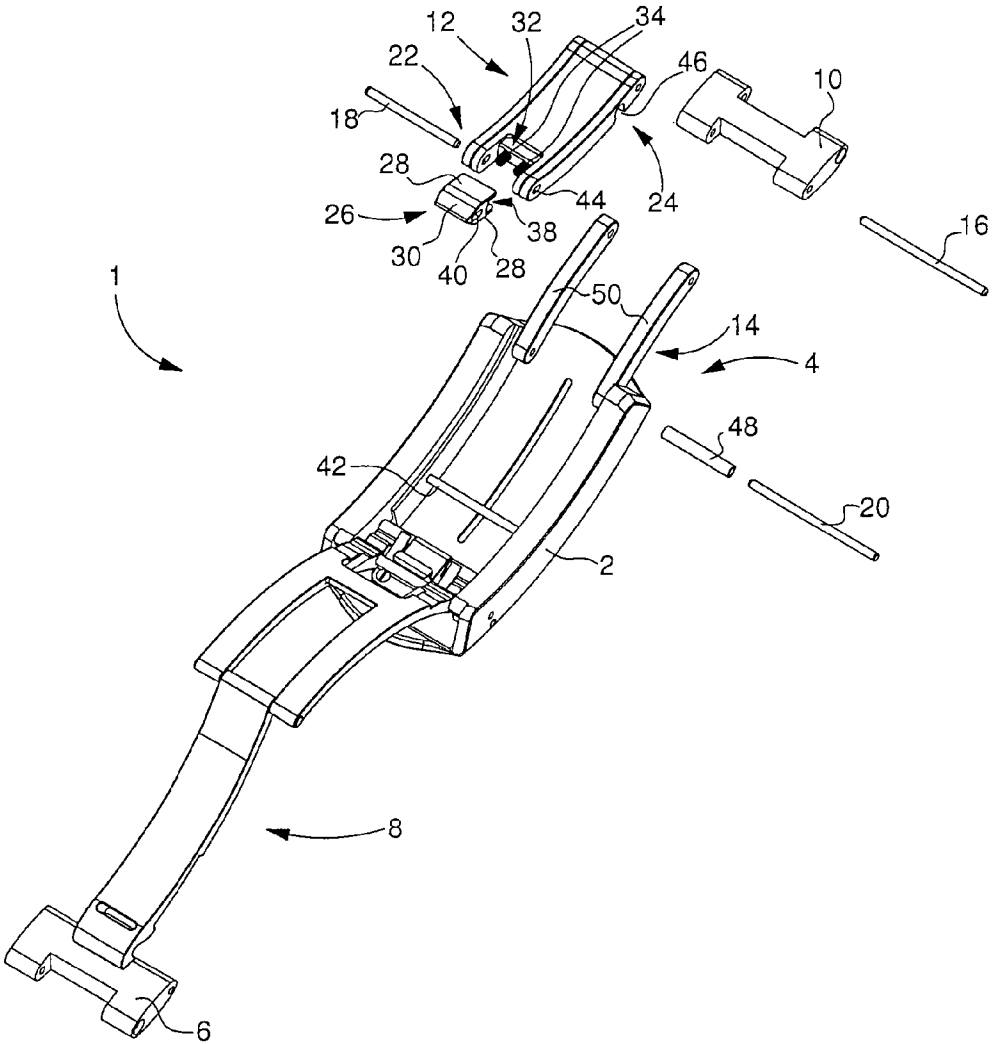
FIG. 1 is an exploded view of the clasp according to the invention.

FIG. 1 is an exploded perspective view of a watch clasp according to the invention. Designated as a whole by the general reference number 1, this clasp essentially includes a cover 2 and a folding system 4. Cover 2 is connected on a first side to a first bracelet strand 6, only one link of which is visible in the drawing, with the insertion of a folding buckle locking system 8, the structure of which is known and will not therefore be described further here. It will be noted that the folding buckle locking system 8 may be omitted and that cover 2 may be directly connected to the first bracelet strand 6. Cover 2 is connected on a second side to a second bracelet strand 10, only one link of which is visible in the drawing, with the insertion of folding system 4 according to the invention.

Folding system 4 according to the invention is formed of a first link 12 and a second link 14. First link 12 is hinged by a first end to the second bracelet strand 10 and by a second end to second link 14 which is in turn hinged to cover 2. More specifically, the first link 12 is fitted with first and second hinge pins 16 and 18. These hinge pins 16 and 18 are parallel to each other and extend transversely to bracelet strands 6 and 10. The first link 12 of folding system 4 is connected to the second bracelet strand 10 by the first hinge pin 16. First link 12 is associated with second link 14 by the second hinge pin 18. Second link 14 is connected in turn to cover 2 of clasp 1 by a third hinge pin 20.

Figure 2B:
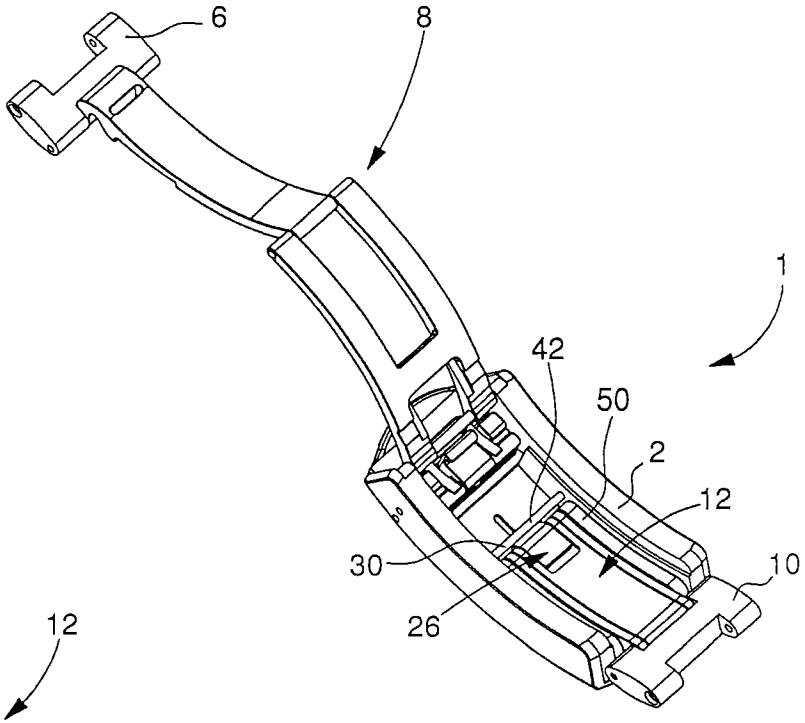
FIGS. 2A and 2B are perspective views of the clasp in the open position and closed position respectively.
Figure 2A:
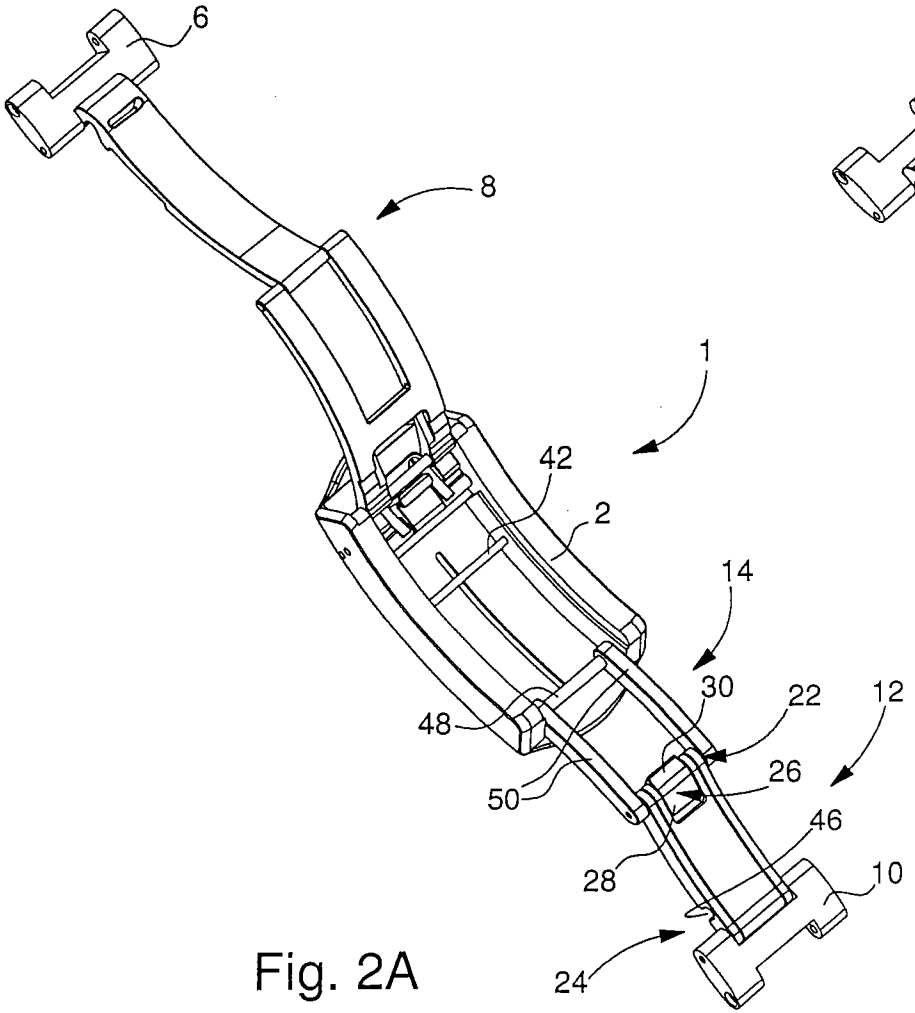
Figure 3:
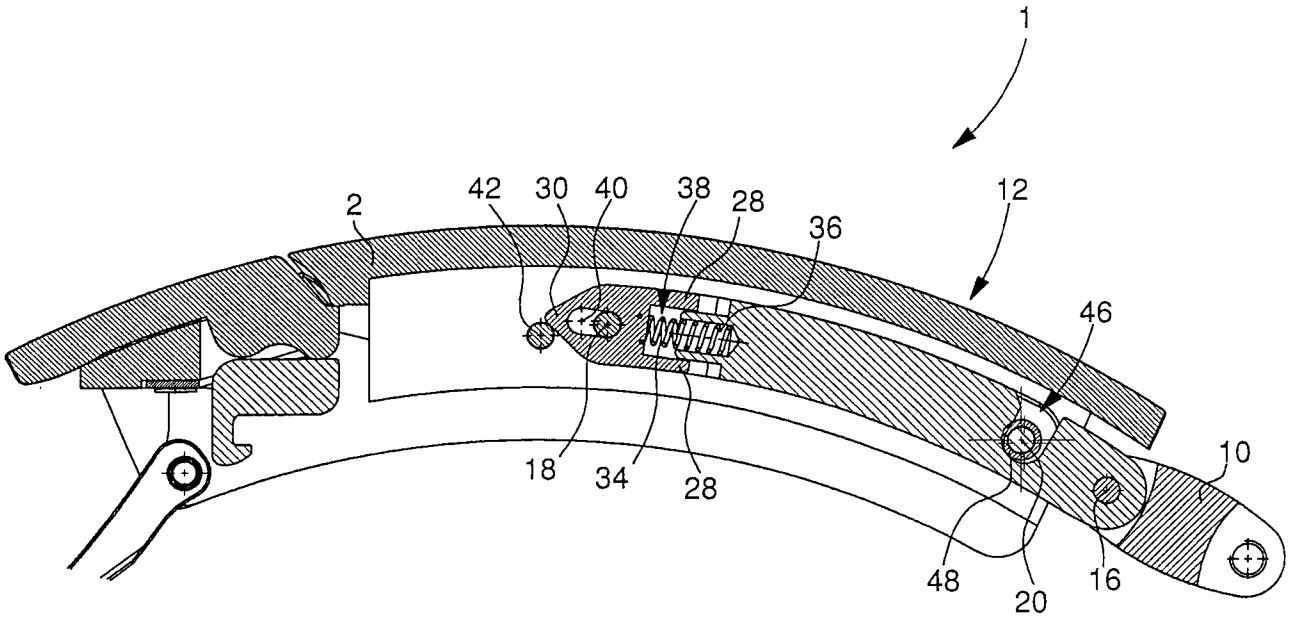
FIG. 3 is a cross-section of the clasp along the length of the bracelet.

Folding system 4 is moveable between a first locked position (FIG. 2B) in which the first and second links 12 and 14 are superposed on each other inside cover 2 of clasp 1, and a second open position (FIG. 2A) in which the first and second links 12 and 14 are unfolded. Folding system 4 can therefore vary the length of the watch bracelet between a first wearing size in which folding system 4 is locked inside cover 2 of clasp 1, so that the user cannot lose his watch, and a second slipping on size in which the folding system is open and which allows the user to put his watch on over his hand. Another way of considering the role of folding system 4 according to the invention is to state that, in the unfolded position, folding system 4 increases the length of the bracelet to enable the user to accommodate the thickness of a diving suit. In this case, this folding system 4 could be designated by the known expression "diver's extension".

When folding system 4 is in the situation where the first and second links 12 and 14 are folded inside cover 2 of clasp 1, the first and second links 12 and 14 must be held securely to prevent any risk of the bracelet sliding along the user's wrist and the watch falling to the ground. First link 12 is therefore held folded onto second link 14 and has first and second elastic locking points, 22 and 24 respectively, for fixing said link 12 inside cover 2 of clasp 1.

The first elastic locking point 22 includes a click 26, the general shape of which is similar to a V and which has two arms 28 connected to each other by a beak 30. This click 26 is engaged in an indentation 32 provided for this purpose in first link 12, at least one and preferably two springs 34 being inserted between first link 12 and click 26. On the side of first link 12, the two springs 34 are engaged in two housings 36 arranged in link 12 and from which they project. On the side of click 26, the two springs 34 abut on the bottom of a groove 38. It will be noted that springs 34 are assembled in a compressed state between click 26 and first link 12. Click 26 is coupled to first link 12 by the second hinge pin 18, via which first link 12 is associated with second link 14. Click 26 therefore has a first oblong hole 40 for the passage of second hinge pin 18. It will thus be clear that, since the second hinge pin 18 passes into an oblong hole 40, click 26 can be moved along the length of the bracelet between a rest position in which it is held by springs 34, and an active position in which it is moved from its rest position against the elastic return force of springs 34 to mesh with a locking pin 42 arranged in cover 2 of clasp 1.

Moreover, first link 12 has a second oblong hole 44 for the passage of the second hinge pin 18 via which first link 12 is associated with second link 14. Finally, first link 12 is provided, at the first end thereof, with second elastic locking point 24 comprising a notch 46 via which first link 12 meshes with a tube 48 secured to cover 2 of clasp 1. Tube 48 also acts as a guide element for the third hinge pin 20 via which second link 14 is associated with cover 2 of clasp 1.

Finally, it will be noted that second link 14 has the shape of a stretcher like frame with two arms 50 between which first link 12 is housed in the first position of folding system 14.

Folding system 4 according to the invention operates as follows. When folding system 4 changes from its second position, in which first and second links 12 and 14 are unfolded, to its first position, in which first and second links 12 and 14 are superposed on each other inside cover 2 of clasp 1, first link 12 is gradually folded down between arms 50 of second link 14 and the assembly formed by first and second links 12 and 14 is housed inside cover 2. Then, pressure simply has to be exerted on the assembly of the first and second superposed links 12 and 14 in order for first link 12 to be fixed via its first and second elastic locking points 22 and 24 inside cover 2 of clasp 1. As a result of this pressure, click 26 moves into its active position. More specifically, click 26 abuts via its beak 30 against locking pin 42 fixed to cover 2 of clasp 1 and is moved axially along the length of the bracelet towards first link 12. During this movement, click 26 counters the elastic return force of springs 34, which are compressed. When first link 12 is completely folded down inside cover 2 of clasp 1, beak 30 of click 26 slides underneath locking pin 42. As click 26 is no longer being held, springs 34 are let down and force beak 30 of click 26 underneath locking pin 42. During this movement, click 26 again moves away from first link 12 and returns to its rest position. During the downward movement of first link 12 onto second link 14 inside cover 2 of clasp 1, first link 12 also becomes meshed with tube 48 via notch 46 thereof. This movement is facilitated by the fact that first link 12 is hinged to second link 14 by second hinge pin 18, which passes through first link 12 via second oblong hole 44. This assembly allows first link 12 to move along the length of the bracelet towards cover 2 of clasp 1. During this movement, first link 12 compresses springs 34 against the bottom of groove 38 which is delimited by the two arms 28 of click 26, which is stationary. Once link 12 is caught on tube 48, springs 34 return to their rest position. At this stage, folding system 4 according to the invention is locked onto cover 2 of clasp 1 by its first and second elastic locking points 22 and 24.

The order in which the first and second locking points 22 and 24 are implemented during the closing movement of folding system 4 is unimportant. In other words, first link 12 may first of all be locked onto cover 2 of clasp 1 via its click 26 and then be locked onto said cover 2 by its notch 46 or vice versa.

To open folding system 4, the first link 12 has to be raised by the first end thereof via which it is hinged to second bracelet strand 10. In doing so, first link 12 moves slightly towards cover 2 of clasp 1, compressing springs 34 against click 26, which is stationary, which allows notch 46 to be released from its mesh with tube 48. When first link 12 continues to be pulled, click 26 moves elastically in the direction of first link 12 compressing springs 34, which enables beak 30 of click 26 to be released from its coupling with locking pin 42.

It goes without saying that this invention is not limited to the embodiment that has just been described and that various simple alterations and variants can be envisaged by those skilled in the art without departing from the scope of the claims annexed to this Patent Application. In particular, tube 48 may be arranged at another place on cover 2 of clasp 1, regardless of third hinge pin 20.

Figure 4:
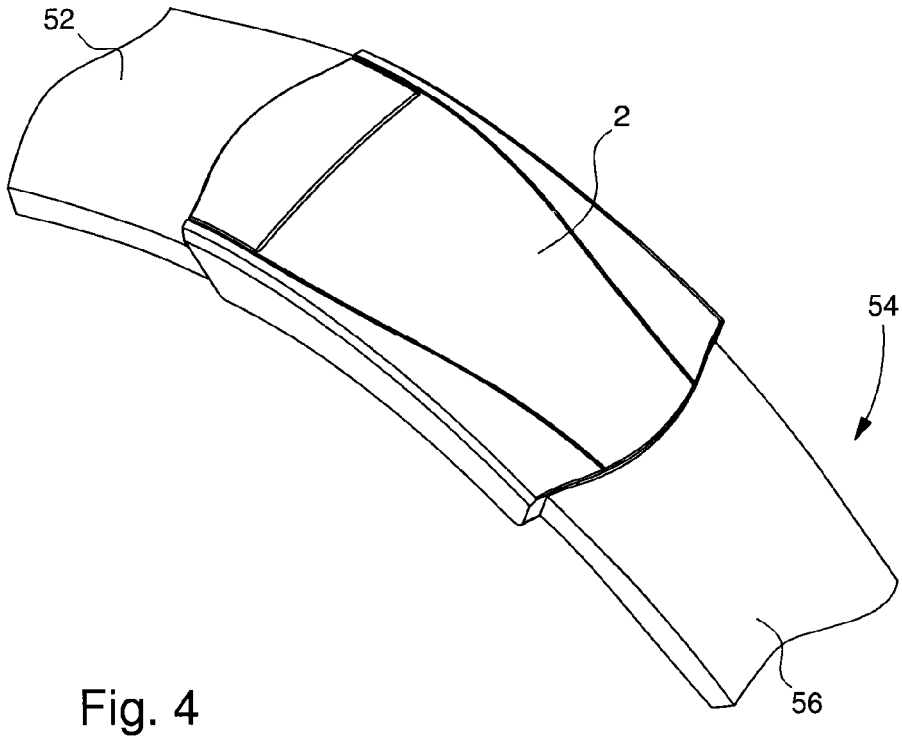
FIG. 4 is a partial perspective view of a belt fitted with the clasp according to the invention.

Likewise, as illustrated in FIG. 4, it goes without saying that the clasp according to the invention may also be used for a belt worn as clothing. In such case, a first end 52 of belt 54 is directly connected to cover 2 of the clasp, whereas the second end 56 of belt 54 is connected to cover 2 of the clasp with the insertion of a folding system 4 according to the invention which includes first and second links 12 and 14.

What is claimed is:

1. A clasp for a watch bracelet or strap or a belt, the clasp comprising:

a cover connected on a first side to a first bracelet strand or belt strand and to a second bracelet strand or belt strand on a second side, a folding system is inserted between the second bracelet strand or belt strand and the cover of the clasp, the folding system including a first link and a second link, wherein the first link is hinged by a first end to the second bracelet strand or belt strand and by a second end to the second link, wherein the first link is connected to the second bracelet strand or belt strand by a first hinge in the first link having a first oblong hole and a second oblong hole for the passage of a second hinge pin via which the first link is associated with the second link, wherein the second link is hinged in turn to the cover of the clasp, wherein the folding system is moveable between a first position in which the first and second links are superposed on each other inside the cover of the clasp and the first link is held folded down between a first and a second arm of the second link, and a second position in which the first and second links are unfolded, wherein the first link includes first and second locking points for fixing the first link in the cover of the clasp, wherein the first and second locking points are controlled by a same elastic locking mechanism, and wherein the first link is provided, on the side of the first end thereof, with a notch via which the first link engages a tube fixed to the cover of the clasp.

2. The clasp according to claim 1, wherein the elastic locking mechanism includes at least one spring.

3. The clasp according to claim 2, wherein the first link includes, on the side of the second end thereof, a click, said click being moveable along a length of the bracelet or belt between a rest position in which said click is held by the at least one spring and an active position in which said click is moved from the rest position thereof against an elastic return force of the at least one spring and engages a locking pin arranged in the cover of the clasp.

4. The clasp according to claim 3, wherein the click includes a first end having a beak to engage the locking pin arranged in the cover of the clasp.

5. The clasp according to claim 3, wherein the click includes a second end having a pair of arms to receive the at least one spring.

6. The clasp according to claim 2, wherein the elastic locking mechanism includes two springs.

7. The clasp according to claim 1, wherein the tube acts as a guide element for a third hinge pin via which the second link is associated with the cover of the clasp.

8. The clasp according to claim 1, wherein the first and the second arm of the second link are spaced apart by a gap between which the first link is housed in the first position of the folding system.

9. The clasp according to claim 1, wherein the elastic locking mechanism is disposed on the second end of the first link.

10. A clasp for a watch bracelet or strap or a belt, the clasp comprising:

a cover connected on a first side to a first bracelet strand or belt strand and to a second bracelet strand or belt strand on a second side, a folding system is inserted between the second bracelet strand or belt strand and the cover of the clasp, the folding system including a first link and a second link, wherein the first link is hingedly connected at a first end to the second bracelet strand or belt strand via a first hinge pin and is hingedly connected at a second end to the second link, wherein the second link is hinged in turn to the cover of the clasp, wherein the folding system is moveable between a first position in which the first and second links are superposed on each other inside the cover of the clasp and the first link is held folded down between a first and a second arm of the second link, and a second position in which the first and second links are unfolded, wherein the first link includes first and second locking points for fixing the first link in the cover of the clasp, wherein the first and second locking points are controlled by a same elastic locking mechanism, wherein the elastic locking mechanism includes at least one spring, wherein the first link includes, on the side of the second end thereof, a click, the click being moveable along a length of the bracelet or belt between a rest position in which the click is held by the at least one spring and an active position in which the click is moved from the rest position thereof against an elastic return force of the at least one spring and engages a locking pin arranged in the cover of the clasp, and wherein, on the side of the second end, of the first link, the first link has an indentation in which the click is engaged, with the insertion of the at least one spring between the click and the first link, wherein the click is coupled to the first link by a second hinge pin via which the first link is associated with the second link, and wherein the click has a first oblong hole for the passage of the second hinge pin.

11. The clasp according to claim 10, wherein the click includes a first end having a beak to engage the locking pin arranged in the cover of the clasp.

12. The clasp according to claim 11, wherein the click includes a second end having a pair of arms to receive the at least one spring.

13. A clasp for a watch bracelet or strap or a belt, the clasp comprising:

a cover connected on a first side to a first bracelet strand or belt strand and to a second bracelet strand or belt strand on a second side, a folding system is inserted between the second bracelet strand or belt strand and the cover of the clasp, the folding system including a first link and a second link, wherein the first link is hingedly connected at a first end to the second bracelet strand or belt strand via a first hinge pin and is hingedly connected at a second end to the second link, wherein the second link is hinged in turn to the cover of the clasp, wherein the folding system is moveable between a first position in which the first and second links are superposed on each other inside the cover of the clasp and the first link is held folded down between a first and a second arm of the second link, and a second position in which the first and second links are unfolded, wherein the first link includes first and second locking points for fixing the first link in the cover of the clasp, wherein the first and second locking points are controlled by a same elastic locking mechanism, wherein the elastic locking mechanism includes at least one spring, wherein the first link includes, on the side of the second end thereof, a click, the click being moveable along a length of the bracelet or belt between a rest position in which the click is held by the at least one spring and an active position in which the click is moved from the rest position thereof against an elastic return force of the at least one spring and engages a locking pin arranged in the cover of the clasp, and wherein, on the side of the second end, of the first link, the first link has an indentation in which the click is engaged, with the insertion of the at least one spring between the click and the first link, wherein the click is coupled to the first link by a second hinge pin via which the first link is associated with the second link, and wherein the click has a first oblong hole for the passage of the second hinge pin, and wherein the first link has a second oblong hole for the passage of the second hinge pin via which the first link is associated with the second link.

14. The clasp according to claim 13, wherein the click includes a first end having a beak to engage the locking pin arranged in the cover of the clasp.

15. The clasp according to claim 14, wherein the click includes a second end having a pair of arms to receive the at least one spring.

* * * * *